US005627019A

United States Patent [19]

Vandenabeele et al.

[11] Patent Number: 5,627,019

[45] Date of Patent: May 6, 1997

[54] METHOD OF PREPARING LIGHT-SENSITIVE SILVER HALIDE EMULSIONS AND DISPERSIONS OF PHOTOGRAPHICALLY USEFUL COMPOUNDS

[75] Inventors: Hubert Vandenabeele, Mortsel; Eric Bertels, Schaffen-Diest, both of Belgium

[73] Assignee: AGFA-Gevaert, N.V., Mortsel, Belgium

[21] Appl. No.: 522,098

[22] Filed: Aug. 31, 1995

[30] Foreign Application Priority Data

Sep. 27, 1994 [EP] European Pat. Off. ..... 94202774

[51] Int. Cl.[6] ..... G03C 1/015

[52] U.S. Cl. ..... 430/569; 430/641

[58] Field of Search ..... 430/569, 641

[56] References Cited

U.S. PATENT DOCUMENTS

| | | | |
|---|---|---|---|
| 5,380,634 | 1/1995 | Kiekens et al. | 430/507 |
| 5,476,761 | 12/1995 | Verbeeck et al. | 430/569 |
| 5,478,709 | 12/1995 | Kiekens et al. | 430/507 |

FOREIGN PATENT DOCUMENTS

| | | | |
|---|---|---|---|
| 0517961 | 12/1992 | European Pat. Off. | G03C 1/04 |
| 0569074 | 11/1993 | European Pat. Off. | G03C 5/17 |

OTHER PUBLICATIONS

F. Csempesz et al., Magy. Kem. Foly. (1979), 85(3), 140–4; English language Chemical Abstract 1979.

*Primary Examiner*—Mark F. Huff

*Attorney, Agent, or Firm*—Breiner & Breiner

[57] ABSTRACT

A method is provided of preparing a light-sensitive silver halide emulsion or a dispersion of a photographically useful compound comprising the steps of precipitating silver halide or photographically useful compound in the presence of colloidal silica serving as a protective colloid, coagulation washing the precipitate formed and redispersing the silver halide or the photographically useful compound, characterised in that the coagulation takes place in the presence of hydroxy ethyl cellulose as, e.g., hydroxy ethyl cellulose, hydroxy propyl cellulose, methyl cellulose etc., as a polymer capable of forming hydrogen bridges with the silica, in an amount sufficient to form coagulable aggregates with the silica particles.

9 Claims, No Drawings

METHOD OF PREPARING LIGHT-SENSITIVE SILVER HALIDE EMULSIONS AND DISPERSIONS OF PHOTOGRAPHICALLY USEFUL COMPOUNDS

DESCRIPTION

1. Field of the Invention

This invention relates to methods of coagulating, washing and redispersing a light-sensitive silver halide emulsion or a dispersion of a compound having photographically useful group(s) that was precipitated in a colloidal medium of silica and to photographic materials incorporating layers comprising emulsions of said silver halide or dispersions of said compound.

2. Background of the Invention

Light-sensitive silver halide emulsions are conventionally prepared by reacting an aqueous silver salt solution, e.g. silver nitrate, with an aqueous alkali metal halide solution to cause precipitation of silver halide in the presence of a protective colloid. After physical ripening to the desired average grain size and washing, a further amount of protective colloid may be added so that the emulsion may be subjected to chemical ripening.

The most commonly used protective colloid is gelatin which is a thermoreversible polymer, showing a sufficient gel strength after coating. Although possessing many advantages, the conventional gelatino-silver halide emulsion layers undergo considerable swelling and subsequent shrinkage upon absorption and release of processing liquids during image processing. This lack of dimensional stability under processing conditions can adversely affect image quality.

Especially the effect of gelatin, adsorbed on and surrounding the silver halide crystal, is rather disadvantageous with respect to development characteristics, e.g. the spatial distribution of silver filaments and the related covering power. This may explain differences in photographic properties obtained between dry and wet coatings.

Moreover, due to their rather slow absorption and release of the processing liquids, conventional gelatino-silver halide layers cannot meet the extremely rapid processing criteria which are often demanded.

With a view to forming light-sensitive layers which have good waterpermeability but which have greater dimensional stability than the conventional gelatino-silver halide layers under processing conditions, many types of ingredients have been proposed for use instead of or in addition to gelatin. These proposed ingredients include various natural film-forming substances and synthetic resins, e.g. polyoxyethylene glycols, ethylacrylate resins, polyvinylpyrrolidone, starch and starch derivatives. For the most part these prior art binding agents have one or another disadvantageous effect on the mechanical or photographic properties of the light-sensitive layer. In particular they tend to reduce light-sensitiviy. Another disadvantage is that some of them, like e.g. polyvinyl alcohol, are not fully compatible as binding agents with gelatin. Especially when in a layer composition dispersions of photographically useful compounds are present that have been prepared in gelatinous medium this incompatibility may form a problem.

A substance proposed in the prior art as protective colloid binder in silver-halide emulsions is colloidal silica. This colloid has no or less adverse effects on light-sensitivity and as disclosed in UK Patent 1276894 silver halide emulsions comprising gelatin together with various proportions of silica sol as a binder have less tendency to swell on treatment with aqueous processing liquids than conventional gelatino-silver halide emulsion layers of the same thickness.

However the necessity to restrict the concentration of the silica sol, for reasons of physical stability, limits the advantage which can be derived from the use of the sol in terms of for instance improved dimensional stability of photographic layers formed from the emulsion. It has been disclosed in EP-B 392 092 to increase the amount of silica sol used as a protective colloid in the preparation of silver halide emulsions, without resulting in unacceptable physical instability of the emulsion. According to that disclosure there is provided a method of preparing a light-sensitive silver halide emulsion by precipitating silver halide in the presence of colloidal silica serving as protective colloid, characterized in that the precipitation takes place in the presence of an onium compound having an emulsion-stabilising effect.

Advantages of layer compositions with silica silver halide emulsions having minimum amounts of gelatin have been described in EP-A 528 476: higher covering power, lower pressure sensitivity, the coating of less silver halide which is more consumer-friendly and rapid processing ability.

The presence of minimum amounts of gelatin as a binding agent in a layer composition may be promoted further by the presence of silica dispersions of photographically useful compounds as has been disclosed in EP-A 569 074, but it remains a desired goal to get completely gelatin-free layers in the layer arrangement of a silver halide photographic material in order to utilize the advantages mentioned hereinbefore to a maximum extent.

Coagulation washing methods for silver halide emulsions the silver halide crystals of which have been precipitated in a gelatin-free medium with silica as a binder have been described in EP-A 517 961. One of the most interesting flocculating agents cited therein however is gelatin so that gelatin-free layers cannot be coated from these coagulation-washed emulsions. Moreover said coagulation methods are time-consuming as the flocculation time is relatively long if compared with the precipitation time.

OBJECTS OF THE INVENTION

It is an object of this invention to prepare gelatin-poor or gelatin-free layer compositions from light-sensitive silver halide emulsions and dispersions of photographically useful compounds for use in silver halide photographic materials.

In particular it is an object of this invention to provide methods of quickly coagulating, washing and redispersing light-sensitive silver halide emulsions or dispersions of compounds having photographically useful groups which have been precipitated in a colloidal medium of silica.

Other objects will become apparent from the description given hereinafter.

SUMMARY OF THE INVENTION

According to the present invention a method is provided of preparing a light-sensitive silver halide emulsion or a dispersion of a photographically useful compound comprising the steps of precipitating silver halide or photographically useful compound in the presence of colloidal silica serving as a protective colloid, coagulation washing the precipitate formed and redispersing the silver halide or the photographically useful compound, characterised in that the coagulation takes place in the presence of at least one cellulose derivative as, e.g., hydroxy ethyl cellulose, hydroxy propyl cellulose, methyl cellulose etc., as a polymer capable of forming hydrogen bridges with the silica, in an amount sufficient to form coagulable aggregates with the silica particles.

According to the present invention silver halide emulsions are prepared by the following steps:

a. Precipitating in aqueous silica medium silver halide by reaction of an aqueous silver salt solution and an aqueous halide solution in aqueous colloidal silica medium wherein said aqueous silica is the sole protective colloid present:

b. Lowering the pH of the said medium to a value of 1.0 to 4.0, preferably from 2.5 to 3;

c. Adding to the said medium at least one cellulose derivative as a hydrogen bridge forming polymer flocculating agent so that aggregates are formed;

d. Removing the clear supernatant liquid formed containing water-soluble salts e.g. by means of a siphon or by decanting;

e. Concentrating the emulsion during precipitation by dialysis or ultrafiltration or after precipitation by dialysis or ultrafiltration until the desirable pAg-value demands are met or by flocculation and decantation, followed by washing and further decantation;

f. Readjusting the pH to a value of 1.0 to 4.0, preferably from 2.5 to 3.0;

g. Removing the clear supernatant liquid;

h. Repeating procedure e to g if flocculation and decantation is applied necessary to meet the desirable pAg-value demands;

i. Causing redispersion of the flocculate by adding an excess of said aqueous colloidal silica or a hydrogen-bridge forming polymer except for gelatin and stirring the redispersed flocculate.

According to the present invention dispersions of compounds having at least one photographically useful group are more particularly prepared by the following steps:

a. Precipitating in aqueous silica medium a photographically useful compound dissolved in a non-watersoluble but alkali-soluble aqueous alkaline solution, whether or not in the presence of a non-aqueous solvent, by lowering the pH of the solution to a value of 1 to 4 in the presence of at least one cellulose derivative as a hydrogen bridge forming polymer flocculating agent in the dispersion vessel so that aggregates are formed;

b. Removing the clear supernatant liquid containing water-soluble salts e.g. by means of a siphon or by decanting;

c. Concentrating the dispersion during the precipitation by dialysis or ultrafiltration or after precipitation by dialysis or ultrafiltration until the desirable pH-value demands are met or by flocculation and decantation, followed by washing and further decantation;

d. Removing the clear supernatant liquid;

e. Repeating procedure c to d if flocculation and decantation is applied necessary to meet the desirable pH-value demands;

f. Causing redispersion of the flocculate by adding an excess of said aqueous colloidal silica or a hydrogen-bridge forming polymer except for gelatin and stirring the redispersed flocculate.

DETAILED DESCRIPTION OF THE INVENTION

From a range of experiments it has been found that cellulose derivatives, preferably hydroxy ethyl cellulose is used as a flocculating agent. Methyl and hydroxy propyl cellullose are not excluded but the sedimentation time is remarkably longer with these two other cellulose derivatives. If necessary, hydroxy ethyl cellulose can be used in combination with other cellulose derivatives or with non-gelatin hydrogen-bridge forming polymers like e.g. polyethylene oxyde, polyethylene imine, polyacrylic acid, polyvinylalcohol, etc. and a combination of two or more of these agents. Although gelatin could be added thereto, it is clear that, within the scope of this invention to coat gelatin-free layers, the use of gelatin has to be avoided.

Moreover if gelatin is used the compatibility disappears to make coatings of layers of silica silver halide emulsions with preferred binder polymers like e.g. polyvinyl alcohol.

For that reason it is recommended to eliminate gelatin in every preparation step of the different compounds used in a photographic composition.

The quantity of flocculating agent can be optimized for each particular case. Amounts of e.g. 1 to 40%, preferably 10 to 40% by weight of flocculating agent versus silica generally give rise to qualitatively good flocculates, which are transportable in a handsome way through e.g. conduct-pipes as they have a "sandy" structure, never showing sticking phenomena. The amount of silica normally used at the stage of precipitation is comprised between 2 and 20 parts by weight with respect to 100 parts by weight of silver nitrate used. Even for the higher amounts of silica, used as a protective colloid in the silver halide precipitation step, it is possible to get a quantitative flocculate.

It is quite obvious that the whole procedure may take place at high or low temperatures as the cellulose derivatives are not gelling at low temperatures. Moreover as no gelatin is used as a protective colloid at the stage of precipitation of the silver halide in the presence of silica the temperature of the reaction vessel can be lowered without risking a jelly structure and unprotected silver halide crystals. To save time, it is not necessary to cool the dispersion at the end of the precipitation.

In order to redisperse the flocculate an excess of the original flocculating agents or combinations thereof as already mentioned hereinbefore can be used in whatever an amount, which depends on the coating requirements. However other colloids than the hydrogen bridge forming polymers mentioned as flocculating agent, can be used in redispersing the coagulate as, e.g. polyvinyl pyrrolidone. Again, within the scope of this invention it is clear that gelatin should preferably be excluded.

In a preferred mode of the invention, silica sol may be added at the stage of redispersion and the ratio by weight of silica sol over silver halide can be regulated. So in EP-B 392 092 even a value exceeding 1.0 is described to be the most preferable one if one wants to avoid the addition of supplemental hardening agents to the emulsion before or during the coating procedure. Any combination of ingredients, being compatible to form a stable colloid system before and during coating, may be used.

Coating with minor amounts of gelatin or even gelatin-free is thus possible, especially on a paper undercoat or substrate.

The average size of the silver halide grains coated in silver halide layers of photographic elements may range from 0.01 to 7 μm. The size distribution of the silver halide particles of the photographic emulsions prepared according to the present invention may be homodisperse or heterodisperse. Homodisperse distributions are obtained when 95% of the grains have a size that does not deviate for more than 30% from the average grain size.

According to the present invention the photographic silver halide can be precipitated by mixing the halide and silver solutions in the silica medium under partially or fully controlled conditions of temperature, concentrations, sequence of addition, and rates of addition. The silver halide grains to be used in practising this invention may be prepared by applying the orderly mixing, inversely mixing, double jet, conversion, core/shell method or the like.

Suitable preparation methods are described e.g. by T. H. James in "The Theory of the Photographic Process", 4th edition (Macmillan, 1977); P. Glafkides in "Chimie et Physique Photographique", Paul Montel, Paris (1967), by G. F. Duffin in "Photographic Emulsion Chemistry", the Focal Press, London (1966), and V. L. Zelikman et al. in "Making and Coating Photographic Emulsion", The Focal Press, London (1966).

The silver halide particles of the photographic emulsions according to the present invention may have a regular crystalline form, e.g. cubic (as has e.g. been described in EP-A 0 649 051), or octahedral or a transition form. Also an irregular crystalline form such as a spherical form or a tabular form (see e.g. EP-A No. 94200933, filed Apr. 6, 1994 and EP-A No. 94201283, filed May 9, 1994) may be obtained. Otherwise the emulsion crystals may have a composite crystal form comprising a mixture of said regular and irregular crystalline forms.

The silver halide grains may also have a multilayered grain structure. The crystals may be doped with whatever a dope, as e.g. with $Rh^{3+}$, $Ir^{4+}$, $Cd^{2+}$, $Zn^{2+}$, $Pb^{2+}$. There are no restrictions concerning the halide composition: chloride, bromide, iodide and any combination may be used.

In accordance with this invention especially tabular silver halide emulsion crystals, prepared in silica sol as a protective colloid and flocculated with at least one cellulose derivative, preferably hydroxy ethyl cellulose, are contemplated.

Separately formed two or more different silver halide emulsions may be mixed for use in accordance with the present invention.

During precipitation grain growth restrainers or accelerators may be added. Although there is no need for grain growth restrainers to prepare ultrafine silver halide crystals it may be useful to add one, e.g., when the temperature is high in the reaction vessel. When preparing ultra fine grains in the presence of growth restrainers, as e.g. phenylmercaptotetrazoles, it should be noted that these restrainers strongly adsorb to the silver halide crystal surface and that it is very difficult, if not impossible to remove them by washing procedures so that their influence on photographic properties persists after coating. Therefore this is preferably avoided. Ultra fine emulsions can act as seed crystals in preparation techniques, making use of Ostwald ripening or recrystallisation steps.

As an essential ingredient the usual silica sols are suitable for the process according to the invention. Suitable silica sols are commercially available such as the "Syton" silica sols (a trademarked product of Monsanto Inorganic Chemicals Div.), the "Ludox" silica sols (a trademarked product of du Pont de Nemours & Co., Inc.), the "Nalco" and "Nalcoag" silica sols (trademarked products of Nalco Chemical Co), the "Snowtex" silica sols of Nissan Kagaku K. K., the "Kieselsol, Types 100, 200, 300, 500 and 600"(trademarked products of Bayer AG), "Remasol-SP-30" (trademarked product of 3M) etc. Especially colloidal silicas having a specific surface area between 100 and 600 $m^2/g$ are preferred.

The light-sensitive silver halide emulsion prepared in accordance with the present invention is, after redispersion, a so-called primitive emulsion. However, the light-sensitive silver halide emulsion prepared according to the present invention can be chemically sensitized as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodanines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

It is clear that due to the absence of gelatin lower amounts of gold can be used in the chemical ripening step as no gold-gelatin complexes are formed. Moreover the use of less gold in the chemical ripening is in favour of storage stability of the coated materials before use.

Within the scope of this invention it is clear that all of the photographically useful compounds that are normally added to a photographic material are preferably prepared in a gelatin-free medium. A non-limitative list of photographically useful compounds of which silica dispersions can be made for incorporation in a photographic silver halide material has already been given in EP-A 569 074, the number of which is incorporated herein by reference and wherein especially for silica solid dispersions of dyes it has clearly been illustrated that solid silica particles are surrounding the dye dispersed in colloidal silica, in the absence of gelatin as a binder.

The silica dispersions obtained can be concentrated making use of the techniques as have been described hereinbefore for silver halide emulsions. It is clear that these very finely divided photographically useful compounds are characterized by a very high photographic activity, if compared with the compounds in a gelatinous dispersion prepared from ball-mill techniques and the like.

The silver halide emulsions prepared in accordance with the present invention can be used to form one or more silver halide emulsion layers coated on a support to form a photographic silver halide element according to well-known techniques.

All ingredients prepared in accordance with the invention may be added in silica dispersed form in various types of photographic elements such as i.a. in photographic elements for graphic arts and for so-called amateur and professional photography, diffusion transfer reversal photographic elements, low-speed and high-speed photographic elements, X-ray materials, micrographic materials, colour materials etc., wherein said elements may be coated partially or completely gelatin-free.

Hydrophilic layers containing silica silver halide emulsions and dispersions of photographically useful compounds in accordance with the present invention may be coated on any suitable substrate such as, preferably, a thermoplastic resin e.g. polyethyelenterephtalate or a polyethylene coated paper support.

The following examples illustrate the invention without however limiting it thereto. All percentages are percentages by weight unless otherwise stated.

EXAMPLES

Example 1

A photographic silver iodobromide emulsion containing 2.0 mole % of silver iodide was prepared by the single jet method in a vessel containing 75 ml of 15% silica sol 'Kieselsol 500' (trademarked product of Bayer AG), 3.5 g of 3,6-dithio-1,8-octanediol as a grain growth accelerator and 50 ml of a 1% stabilizing sulfonium compound according to formula (I) given hereinafter.

The temperature was stabilized at 55° C. The obtained emulsion was of an average grain size of 0.50 μm, containing an amount of silver halide corresponding to approximately 60 g of silver nitrate per kg of the dispersion after addition of 3 moles of silver nitrate at a constant rate of 150 ml·min−1.

After physical ripening the original pH value of 4.8 was adjusted to a value between 2.5 and 3.0 with hydrochloric acid.

From this dispersion 11 equal parts of 250 ml each were taken and different amounts of polystyrene sulphonic acid (dilution: 1/10) (PSS), gelatin Koepff t16353 (solution: 3.1%) (GELK), phtalated gelatin Rousselot, t16875 (solution 3.1%) (PHTHGEL) and hydroxy ethyl cellulose (HEC) (2% solution of NATROSOL 250L, trademark product of HERCULES) were added as flocculating agents as summarised in Table 1.

After 15 minutes amounts of these flocculating agent were added to the dispersion as summarised in Table 1. Stirring was ended after addition of this flocculating agent.

The emulsion was coagulated and for each sample the velocity of sedimentation (VS) was measured and expressed in cm·min$^{-1}$. Together with a qualitative judgement of turbidity (TURB) (clear, slightly cloudy, light cloudy, very cloudy) indicated respectively by the abbreviations C-SC-LC-VC the results of the velocities of sedimentation (VS) are represented in Table 1.

It has to be noted that in all cases, no silver loss has been detected.

TABLE 1

| Sample No. | PSS | GELK | PHTHGEL | HEC | VS (cm · min$^{-1}$) | TURB |
|---|---|---|---|---|---|---|
| 1 | 3.70 | 18.90 | | | 33.0 | C |
| 2 | | | 18.90 | | 25.0 | C |
| 3 | | | | 10.65 | 31.0 | SC |
| 4 | | | | 5.00 | 31.0 | SC |
| 5 | | | | 5.00 | 35.0 | SC |
| 6 | | | | 2.00 | 20.0 | VC |

TABLE 1-continued

| Sample No. | PSS | GELK | PHTHGEL | HEC | VS (cm · min$^{-1}$) | TURB |
|---|---|---|---|---|---|---|
| 7 | | | | 3.00 | 32.0 | SC |
| 8 | | | | 4.00 | 33.0 | SC |
| 9 | | | | 6.00 | 35.0 | SC |
| 10 | | | | 7.00 | 35.0 | SC-C |
| 11 | | | | 14.65 | 27.0 | SC |

As can be seen from Table 1 the use of hydroxy ethyl cellulose as a flocculating agent gives rise to a high sedimentation velocity and an acceptable turbidity, provided that an amount of at least 3 ml (2%) is used which corresponds with an amount of 0.71 g per g of silica used as a binder during precipition of the silver bromoiodide emulsion crystals in this example. Sedimentation characteristics are comparable with those obtained with gelatin or gelatin derivatives. However as no gelatin is used an extra degree of freedom is obtained in order to prepare gelatin-free coatings.

Example 2

A photographic silver iodobromide emulsion containing 2.0 mole % of silver iodide was prepared by the double jet method at a constant pAg value in a vessel containing 4000 ml of demineralised water and 300 ml of 15% silica sol 'Kieselsol 500' (trademarked product of Bayer AG), 2.5 g of 3,6-dithio-1,8-octanediol as a grain growth accelerator and 50 ml of a 1% stabilizing sulfonium compound according to formula (I). The temperature was stabilized at 70° C. The precipitation stage was divided into two parts: 1.1% of the silver nitrate was consumed in the nucleation step at a constant pAg (vs. Ag/AgC1 as a reference electrode) of −45.6 mV and at a constant flow rate of 66.0 ml/min. of the silver nitrate and potassium bromide/iodide solutions; 98.9% was consumed during the growth step, which proceeded at the same constant flow rate.

The obtained emulsion had an octahedrical habit and was of an average grain size of 0.50 μm, containing an amount of silver halide corresponding to approximately 60 g of silver nitrate per kg of the dispersion after addition of 3 moles of silver nitrate.

After physical ripening the original pH value of 4.8 was adjusted to a value between 2.5 and 3.0 with sulphuric acid.

From this dispersion 25 equal parts of 200 ml each were taken and different amounts of polystyrene sulphonic acid (dilution: 1/10) (PSS), gelatin Koepff t16353 (solution: 3.1%) (GELK), phthalated gelatin Rousselot t16875 (solution: 3.1%) (PHTHGEL), carbamoyl gelatin Rousselot t20945 (solution: 3.1%) (CGL), Ca containing gelatin Koepff t16786 (solution: 3.1%) (CaGL), S66639 gelatin (Stoess, 3.1%) (S66) and hydroxy ethyl cellulose (2% NATROSOL 250L) (HEC) were added as flocculating agents as summarised in Table 2.

After 15 minutes amounts of these flocculating agent were added to the dispersion as summarised in Table 1. Stirring was ended after addition of this flocculating agent. The emulsion was coagulated and for each sample the velocity of sedimentation (VS) was measured and expressed in cm·min$^{-1}$. A qualitative judgement of turbidity is given just as in Table 1.

As can be seen from Table 2 the use of hydroxy ethyl cellulose as a flocculating agent, especially in combination with polystyrene sulphonic acid, gives rise to a high sedimentation velocity and a clear solution without turbidity, provided that an amount of at least ca. 5 ml (2%) is used which corresponds with an amount of 0.08 g per g of silica sol used as a binder during precipition of the silver bromoiodide emulsion crystals in this example. Even in a medium with high amounts of silica sedimentation characteristics are very good, whereas if such a high amount of gelatin or gelatin derivatives is present, it is difficult to get a quantitative sedimentation of the silver halide emulsion crystals. As a consequence loss in silver has to be expected.

TABLE 2

| Sample No. | PSS | GELK | PHTHGL | HEC | CGL | CaGL | S66 | VS | TURB |
|---|---|---|---|---|---|---|---|---|---|
| 1 | 0.28 | | 17.84 | | | | | 1.5 | C |
| 2 | 0.28 | | | | | | 17.8 | 8.0 | C |
| 3 | 0.28 | | | | 17.8 | | | 1.0 | VC |
| 4 | 0.28 | 17.84 | | | | | | 8.0 | C |
| 5 | 0.28 | | | | | 17.8 | | 8.0 | C |
| 6 | | | | 11.06 | | | | 22.0 | VC |
| 7 | | | 17.84 | 11.06 | | | | 25.0 | LC |
| 8 | | | 17.84 | 4.46 | | | | 1.5 | C |
| 9 | | 17.84 | | 4.46 | | | | 2.0 | C |
| 10 | 0.28 | 19.60 | | | | | | 19.0 | C |
| 11 | 0.28 | 19.60 | | 3.00 | | | | 19.0 | C |
| 12 | 0.28 | 20.00 | | | | | | 2.0 | C |
| 13 | 0.28 | 18.60 | | | | | | 10.0 | C |
| 14 | | | 19.60 | 5.00 | | | | 12.5 | C |
| 15 | | | 19.60 | | | | | 3.0 | C |
| 16 | | | | | | | 19.6 | 24.0 | C |
| 17 | | 19.60 | | | | | | 19.0 | C |
| 18 | | | | | | | | — | — |
| 19 | | | | 11.06 | | | | 15.0 | VC |
| 20 | 0.28 | | 19.60 | 4.90 | | | | 12.5 | C |
| 21 | 0.28 | | | 4.90 | | | 19.6 | 26.0 | C |
| 22 | 0.28 | | | 4.90 | 19.6 | | | 3.0 | C |
| 23 | 0.28 | | | 4.90 | | 19.6 | | 26.0 | C |
| 24 | 0.28 | 19.60 | | 4.90 | | | | 26.0 | C |

As no gelatin is used in the whole precipitation and flocculation procedure an extra degree of freedom is obtained again in order to prepare gelatin-free coatings.

It has further been proved that the silica emulsions and dispersions according to this invention are redispersed very easily. In the absence of gelatin it has moreover been proved that coatings can be made of said emulsions and dispersions in the presence of polymers and derivatives therefrom like e.g. polyvinyl alcohol, polyacrylic acid, polyoxyalkylenes and polyethyleneimine which are not compatible with gelatin. As a consequence non-gelatinous hydrophilic layers can be coated with especially preferred characteristics as e.g. a low swelling degree (low water absorption) in favour of rapid drying properties in the (rapid) processing cycle, less ultraviolet absorption as has been suggested in U.S. Pat. No. 5,284,744 wherein the use of potatoe starch as a binder for silver halide crystals has been disclosed, higher covering power and less pressure sensitivity.

We claim:

1. Method of preparing a light-sensitive silver halide emulsion or a dispersion of a photographically useful compound comprising the steps of precipitation of silver halide or a photographically useful compound in the presence of colloidal silica serving as a protective colloid, coagulation washing of the precipitate formed and redispersing the silver halide or the photographically useful compound, characterized in that the coagulation takes place in the presence of hydroxy ethyl cellulose as a polymer capable of forming hydrogen bridges with the silica, in an amount sufficient to form coagulable aggregates with the silica particles.

2. Method according to claim 1, wherein the hydroxy ethyl cellulose, acting as flocculating agent, is used in combination with polyethylene oxide, polyethylene imine, polyacrylic acid, polyvinyl alcohol, starch or polystyrene sulphonic acid or a combination of two or more of these agents.

3. Method according to claim 1, wherein the hydroxy ethyl cellulose is present in an amount of 1 to 40% by weight versus silica.

4. Method according to claim 1, wherein the colloidal silica has a specific surface area between 200 and 600 $m^2/g$.

5. Method according to claim 1, wherein the silver halide emulsion is a tabular silver halide emulsion.

6. Method of preparing light-sensitive silver halide emulsions by the following steps:

a. precipitating in aqueous silica medium silver halide by reaction of an aqueous silver salt solution and an aqueous halide solution in aqueous colloidal silica medium wherein said aqueous silica is the sole protective colloid present;

b. lowering the pH of the said medium to a value of 1.0 to 4.0.

c. adding to the said medium hydroxy ethyl cellulose as a hydrogen bridge forming polymer flocculating agent so that aggregates are formed;

d. removing the clear supernatant liquid formed containing water-soluble salts by means of a siphon or by decanting;

e. concentrating the emulsion during precipitation by dialysis or ultrafiltration or after precipitation by dialysis or ultrafiltration or by flocculation and decantation, followed by washing and further decantation;

f. readjusting the pH to a value of 1.0 to 4.0;

g. removing the clear supernatant liquid;

h. repeating procedure e to g if flocculation and decantation are applied;

i. causing redispersion of the flocculate by adding an excess of said aqueous colloidal silica or a hydrogen-bridge forming polymer except for gelatin and stirring the redispersed flocculate.

7. Method according to claim 6, wherein the pH is readjusted to a value of 2.5 to 3.0.

8. Method according to claim 6, wherein redispersion is caused by additional of one or more of the following compounds being colloidal silica, hydroxy ethyl cellulose, hydroxy propyl cellulose, methyl cellulose, polyethylene oxide, polyethylene imine, polyacrylic acid, polyvinyl alcohol, starch or polystyrene sulphonic acid or a combination of two or more of these agents.

9. Method of preparing dispersions of compounds having at least one photographically useful group by the following steps:

a. precipitating in aqueous silica medium photographically useful compound in a non-watersoluble but alkali-soluble aqueous alkaline solution, whether or not in the presence of a non-aqueous solvent, by lowering the pH of the solution to a value of 1 to 4 in the presence of at least one cellulose derivative as a hydrogen bridge forming polymer flocculating agent in a dispersion vessel so that aggregates are formed;

b. removing the clear supernatant liquid containing water-soluble salts by means of a siphon or by decanting;

c. concentrating the dispersion during the precipitation by dialysis or ultrafiltration or after precipitation by dialysis or ultrafiltration or by flocculation and decantation, followed by washing and further decantation;

d. removing the clear supernatant liquid;

e. repeating procedure c to d if flocculation and decantation is applied;

f. causing redispersion of the flocculate by adding an excess of said aqueous colloidal silica or a hydrogen-bridge forming polymer except for gelatin and stirring the redispersed flocculate.

* * * * *